United States Patent [19]

Filzen et al.

[11] Patent Number: 4,975,152

[45] Date of Patent: Dec. 4, 1990

[54] ENCLOSED EXTENDED NIP PRESS APPARATUS WITH INFLATABLE SEALS AND BARBS

[75] Inventors: Scott E. Filzen; David V. Lange, both of Beloit, Wis. Timothy L. Hauser, Jefferson, Wis.

[73] Assignee: Beloit Corporation, Beloit, Wis.

[21] Appl. No.: 376,330

[22] Filed: Jul. 6, 1989

[51] Int. Cl.[5] ..... D21F 3/08

[52] U.S. Cl. ..... 162/358; 100/153; 162/361

[58] Field of Search ..... 162/358, 361; 100/118, 100/153, 154; 29/113.1, 116.1

[56] References Cited

U.S. PATENT DOCUMENTS

| | | | |
|---|---|---|---|
| Re. 31,923 | 6/1985 | Justus et al. | 162/358 |
| 3,269,893 | 8/1966 | Rojecki | 162/361 |
| 3,804,707 | 4/1974 | Mohr et al. | 162/358 |
| 4,044,669 | 8/1977 | Luther | 29/117 |
| 4,201,624 | 5/1980 | Mohr et al. | 162/205 |
| 4,287,021 | 9/1981 | Justus et al. | 162/358 |
| 4,555,305 | 11/1985 | Steiner et al. | 162/205 |
| 4,563,245 | 1/1986 | Wanke et al. | 162/358 |
| 4,570,314 | 2/1986 | Holik et al. | 100/93 RP |
| 4,584,059 | 4/1986 | Schiel et al. | 162/361 |
| 4,625,376 | 12/1986 | Schiel et al. | 29/119 |

FOREIGN PATENT DOCUMENTS

| | | | |
|---|---|---|---|
| 3239954 | 5/1984 | Fed. Rep. of Germany . | |
| 3317455 | 11/1984 | Fed. Rep. of Germany . | |
| 3317456 | 11/1984 | Fed. Rep. of Germany . | |
| 3317457 | 11/1984 | Fed. Rep. of Germany . | |
| 3338487 | 5/1985 | Fed. Rep. of Germany . | |
| 2222482 | 10/1974 | France . | |
| 88/03192 | 5/1988 | PCT Int'l Appl. | 162/358 |
| 2057027 | 3/1981 | United Kingdom . | |

*Primary Examiner*—Karen M. Hastings

*Attorney, Agent, or Firm*—Dirk J. Veneman; Raymond W. Campbell; David J. Archer

[57] ABSTRACT

An enclosed extended nip press apparatus is disclosed for pressing water from a formed web. The apparatus includes a frame and a backing roll rotatably secured to the frame. A press member cooperates with a backing roll for defining therebetween an extended nip for the passage therethrough of the formed web. A press blanket extends in a closed loop through the nip, the blanket having a first and a second lateral edge and an inner and an outer surface. A first and a second head are rotatably secured to the press member with the first and second heads being disposed adjacent to and cooperating with the first and the second edges respectively of the blanket. The first and the second heads define first and second annular channels respectively for the reception therein of the first and the second lateral edges respectively of the blanket. A first and a second annular seal are disposed within respectively the first and the second channels with the seals contacting the respective edges of the blanket. A first and second plurality of barbs extend from the first and the second channels respectively such that the first plurality of barbs extend towards and engage the first lateral edge of the blanket and are disposed on the opposite surface of the blanket relative to the first seal. The second plurality of barbs extend towards and engage the second lateral edge of the blanket. The second plurality of barbs are disposed on the opposite surface of the blanket relative to the second seal so that during use of the apparatus, lateral movement of the edges of the blanket relative to the heads is inhibited.

12 Claims, 2 Drawing Sheets

ENCLOSED EXTENDED NIP PRESS APPARATUS WITH INFLATABLE SEALS AND BARBS

BACKGROUND OF THE INVENTION

1. FIELD OF THE INVENTION

The present invention relates to an enclosed extended nip press apparatus for pressing water from a formed web.

More particularly, the invention relates to a seal for sealing the lateral edges of a press blanket during lateral movement thereof.

2. INFORMATION DISCLOSURE STATEMENT

A typical extended nip press includes a backing roll and a cooperating press shoe defining therebetween an extended nip. A press blanket extends in an endless loop through the nip and a lubricant is supplied between the press shoe and an inner surface of the press blanket in order to permit the blanket to move relative to the shoe through the extended nip so that the blanket moves contiguously with a formed web through the nip.

At relatively low operational speeds, lubrication of the press blanket presents few problems. However, at high operational speeds, particularly above 3,000 feet per minute, there exists a tendency for oil mist to be generated within the loop of the press blanket. Such oil mist tends to settle on ancillary equipment including hand rails and access walkways.

Additionally, there exists the possibility of oil contaminating the formed web on the opposite side of the blanket.

In view of the aforementioned problems, many proposals have been made in an attempt to completely enclose the press blanket of an extended nip press. Although the end sealing of such impervious press blanket would present no problem if the blanket remained cylindrical in use, such is not the case. Because of the inherent apple-shaped side-elevational configuration attained by the press blanket in use of the extended nip press, sealing of the lateral edges of the blanket poses relatively complex sealing problems.

In West German Published Application No. DE3338487, inflatable seals are mounted on rotatable heads such that the seals support the inner surface of the blanket adjacent to the lateral edges thereof.

Although the aforementioned arrangement permits movement of the lateral edges of the blanket through the extended nip due to the compressibility of the inflatable seals, there exists the tendency for the lateral edges of the blanket to wander relative to the area of contact with the respective inflatable seal.

U.S. Pat. No. 4,625,376 to Schiel et al sought to overcome the aforementioned problem by the provision of a relatively complex sealing arrangement which included providing a plurality of tongues cut in the lateral edges of the blanket, such tongues being folded radially inward and clamped to the rotating heads.

The present invention provides a simple means for securing the lateral edges of a press blanket against lateral wandering thereof while providing positive sealing against leakage of lubricating oil or mist between the lateral edges of the press blanket and the rotating heads.

Accordingly, the present invention provides a significant improvement over the prior art arrangements and makes a considerable contribution to the enclosed extended nip press apparatus art.

Another object of the present invention is the provision of an enclosed extended nip press apparatus which includes a first and a second plurality of barbs which extend from first and second channels respectively defined by the heads for engaging the lateral edges of the blanket so that during use of the apparatus, lateral movement of the edges of the blanket relative to the heads is inhibited.

Another object of the present invention is the provision of an extended rip press apparatus in which each of the heads defines a circumferential rim, an extension rim extending radially outward from the circumferential rim and a cylindrical rim secured to the first extension rim and disposed coaxially and spaced relative to the circumferential rim such that the circumferential rim, the extension rim, and the cylindrical rim define therebetween the respective channels for the reception therein of the lateral edges of the blanket.

Another object of the present invention is the provision of annular seals disposed within the channels, the seals being disposed on the opposite side of the lateral edges of the blanket relative to the plurality of barbs so that lateral movement of the lateral edges of the press blanket is inhibited.

Another object of the present invention is the provision of an extended nip press apparatus in which each of the heads includes a pair of sectors, the sectors being pivotally secured relative to each other about a pivotal axis extending diametrically across the respective head such that outward pivoting of the sectors about the pivotal axis permits release of the respective lateral edge of the blanket from the associated plurality of barbs.

Another object of the present invention is the provision of an extended nip press apparatus in which the annular seals are inflatable so that inflation of the seals urges the lateral edge of the blanket into locking engagement with the associated plurality of barbs.

Other objects and advantages of the present invention will be readily apparent to those skilled in the art by consideration of the detailed description contained hereinafter taken in conjunction with the annexed drawings.

SUMMARY OF THE INVENTION

The present invention relates to an enclosed extended nip press apparatus and method for pressing water from a formed web. The apparatus includes a frame and a backing roll rotatably secured to the frame. A press member cooperates with the backing roll for defining therebetween an extended nip for the passage therethrough of the formed web. A press blanket extends in a closed loop through the nip, the blanket having a first and a second lateral edge and an inner and an outer surface. A first and a second head are rotatably secured to the press member with the first and second heads being disposed adjacent to and cooperating with the first and the second edges respectively of the blanket. The first and second heads define first and second annular channels respectively for the reception therein of the first and second lateral edges respectively of the blanket. A first and a second annular seal are disposed within the respective first and second channels such that the seals contact the respective edges of the blanket. A first and a second plurality of barbs extend from the first and the second channels respectively such that the first plurality of barbs extend towards and engage and penetrate the first lateral edge of the blanket and are disposed on the opposite surface of the blanket relative to the first seal. The second plurality of barbs extend towards and engage and penetrate the second lateral edge of the blanket. The second plurality of barbs are disposed on the opposite surface of the blanket relative to the second seal so that during use of the apparatus, lateral movement of the edges of the blanket relative to the heads is inhibited.

In a more specific embodiment of the present invention, the press member includes a housing which defines a cylinder, the cylinder being controllably connected to a source of hydraulic pressure. An elongate pressing shoe slidably cooperates with the cylinder such that when the cylinder is connected to the source of hydraulic pressure, the shoe is urged towards the backing roll for pressing water from the web.

In one embodiment of the present invention, the blanket is vented, and in a more specific embodiment of the present invention, the blanket defines a plurality of machine direction grooves for assisting drainage of water pressed from the formed web during passage of the web through the extended nip.

In one embodiment of the present invention, the blanket is fabricated from a resin binder with randomly oriented fibers dispersed therein.

In the present invention, the inner surface of the blanket cooperates with and moves relative to the elongate pressing shoe.

The first and the second heads are of disc-shaped configuration with the heads rotating about a common axis disposed parallel and spaced relative to the rotational axis of the backing roll, the first head having a diameter substantially the same as the diameter of the second head.

In a preferred embodiment of the present invention, each of the heads includes a circumferential rim disposed coaxially relative to a common rotational axis of the heads, a first extension rim extending radially outward from the circumferential rim, and a cylindrical rim secured to the extension rim and disposed coaxially and spaced relative to the circumferential rim such that the circumferential rim, the extension rim and the cylindrical rim define therebetween a channel for the reception therein of the receptive lateral edge of the blanket.

In one embodiment of the present invention, each of the heads includes a pair of sectors. Each of the sectors are pivotally secured relative to each other about a pivotal axis extending diametrically across the respective head such that outward pivoting of the sectors about the pivotal axis permits release of the respective lateral edge of the blanket from the plurality of barbs.

In a preferred embodiment of the present invention, the annular seals are inflatable with the first seal being disposed within a first channel such that the first seal contacts a first circumferential rim, a first extension rim and the inner surface of the blanket. The second seal is disposed within a second channel of the head such that the second seal contacts the second circumferential rim, a second extension rim and the inner surface of the blanket.

Furthermore, the first plurality of barbs extend from the first cylindrical rim towards the first extension rim while the second plurality of barbs extend from the second cylindrical rim towards the second extension rim such that the first and the second plurality of barbs lock the respective edges of the blanket within the first and the second channels respectively.

Many modifications and variations of the present invention will be apparent to those skilled in the art by a consideration of the detailed description contained hereinafter taken in conjunction with the annexed drawings showing a preferred embodiment of the present invention. Such modifications and variations which include the provision of a hydrostatic shoe or a hybrid hydrostatic and hydrodynamic shoe do not depart from the spirit and scope of the present invention as defined by the appended claims.

Figure 1:
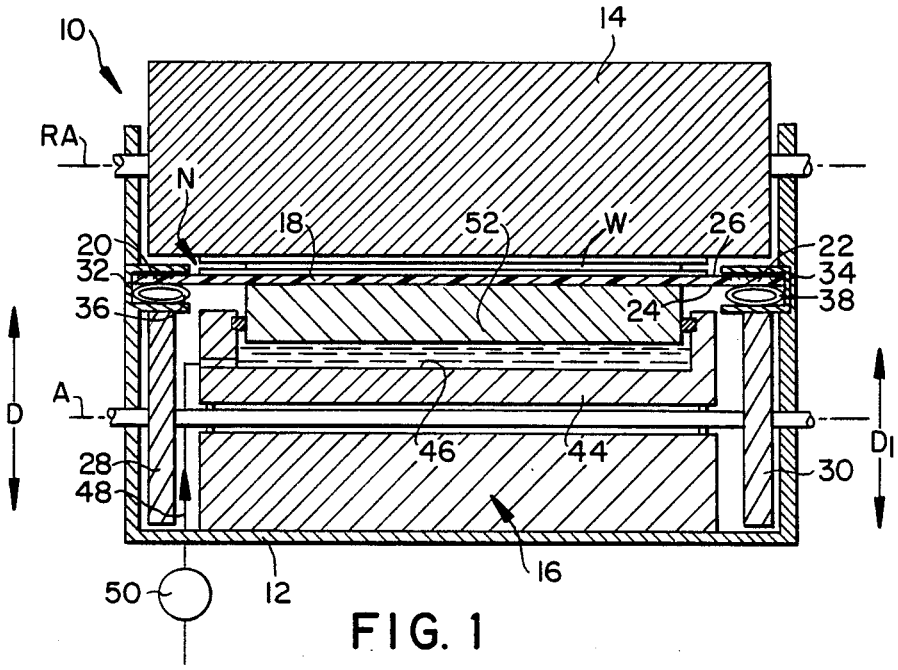
FIG. 1 is a side-elevational view of an extended nip press apparatus according to the present invention showing the disposition of the press blanket.

DETAILED DESCRIPTION OF THE DRAWINGS:

FIG. 1 is a side-elevational view of an enclosed extended nip press apparatus generally designated 10 according to the present invention for pressing water from a formed web W. The apparatus 10 includes a frame 12 and a backing roll 14 rotatably secured to the frame 12. A press member generally designated 16 cooperates with the backing roll 14 for defining therebetween an extended nip generally designated N for the passage therethrough of the formed web W. A press blanket 18 extends in a closed loop through the nip N. The blanket 18 has a first and a second lateral edge 20 and 22 respectively and an inner and an outer surface 24 and 26 respectively.

A first and a second head 28 and 30 respectively are rotatably secured to the press member 16. The first and the second heads 28 and 30 respectively are disposed adjacent to and cooperate with the first and the second edges 20 and 22 respectively of the blanket 18.

The first and the second heads 28 and 30 define first and second annular channels 32 and 34 respectively for the reception therein of the first and the second lateral edges 20 and 22 respectively of the blanket 18.

A first and a second annular seal 36 and 38 respectively are disposed within the first and the second channels 32 and 34. The seals 36 and 38 contact the respective edges 20 and 22 of the blanket 18.

Figure 2:
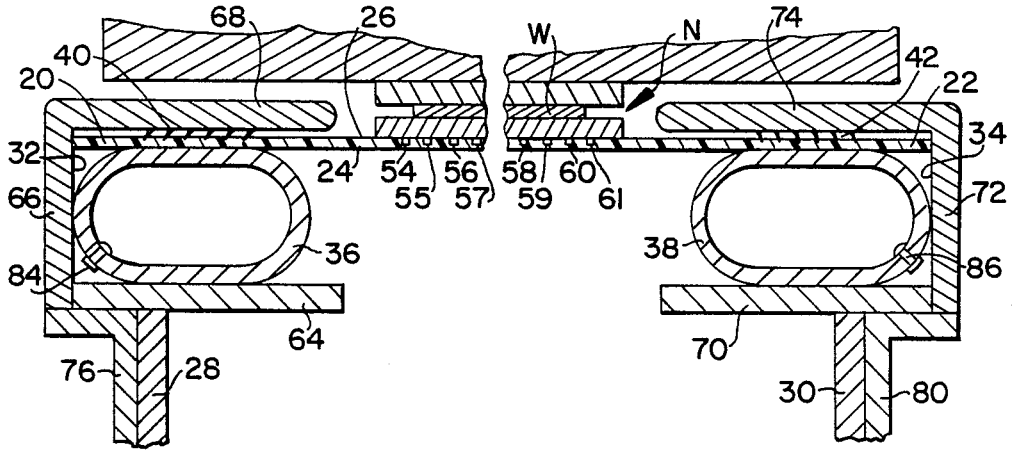
FIG. 2 is an enlarged fragmentary sectional view of the first and the second rotatable head, together with the first and second channel defined therein.

FIG. 2 is an enlarged fragmentary sectional view of the first and second heads 28 and 30, and shows a first and a second plurality of barbs 40 and 42 respectively extend from the first and the second channels 32 and 34 respectively such that the first plurality of barbs 40 extend towards and engages and penetrates the first lateral edge 20 of the blanket 18 and are disposed on the opposite surface 26 of the blanket 18 relative to the first seal 36.

The second plurality of barbs 42 extend towards and engages and penetrates the second lateral edge 22 of the blanket 18. The second plurality of barbs 42 are disposed on the opposite surface 26 of the blanket 18 relative to the second seal 38 so that during use of the apparatus 10, lateral movement of the edges 20 and 22 of the blanket 18 relative to the heads 28 and 30 respectively is inhibited.

More specifically, the press member 16 includes a housing 44 shown in FIG. 1 defining a cylinder 46. The cylinder 46 is controllably connected as indicated by 48 to a source of hydraulic pressure 50. An elongate pressing shoe 52 slidably cooperates with the cylinder 46 such that when the cylinder 46 is connected to the source of hydraulic pressure 50, the shoe 52 is urged towards the backing roll 14 for pressing water from the web W.

In a preferred embodiment of the present invention, the blanket 18 is vented and more specifically, as shown in FIG. 2, the blanket 18 defines a plurality of machine direction grooves 54, 55, 56, 57, 58, 59, 60 and 61 for assisting drainage of water pressed from the formed web W during passage of the web W through the extended nip N.

The blanket 18 preferably is fabricated from a resin binder with randomly oriented fibers dispersed therein as taught in co-pending patent application no. 07/179,086. All the subject-matter of co-pending patent application no. 07/179,806 is incorporated herein by reference.

The inner surface 24 of the blanket 18 cooperates with and moves relative to the elongate pressing shoe 52.

As shown particularly in FIG. 1 the first and the second heads 28 and 30 respectively are of disc-shaped configuration. The heads 28 and 30 rotate about a common axis A which is disposed parallel and spaced relative to the rotational axis RA of the backing roll 14. The first head 28 has a diameter D which is substantially the same as the diameter D1 of the second head 30.

As shown in FIG. 2, the first head 28 also includes a first circumferential rim 64 which is disposed coaxially relative to the common axis A. A first extension rim 66 extends radially outward from the first circumferential rim 64. A first cylindrical rim 68 is secured to the first extension rim 66 and is disposed coaxially and spaced relative to the first circumferential rim 64 such that the first circumferential rim 64, the first extension rim 66, and the first cylindrical rim 68 define therebetween the first channel 32 for the reception therein of the first lateral edge 20 of the blanket 18.

Furthermore, the second head 30 includes a second circumferential rim 70 which is disposed coaxially relative to the common axis A. A second extension rim 72 extends radially outward from the second circumferential rim 70 and a second cylindrical rim 74 is secured to the second extension rim 72 and is disposed coaxially and spaced relative to the second circumferential rim 70 such that the second circumferential rim 70, the second extension rim 72 and the second cylindrical rim 74 define therebetween the second channel 34 for the reception therein of the second lateral edge 22 of the blanket 18.

Figure 3:
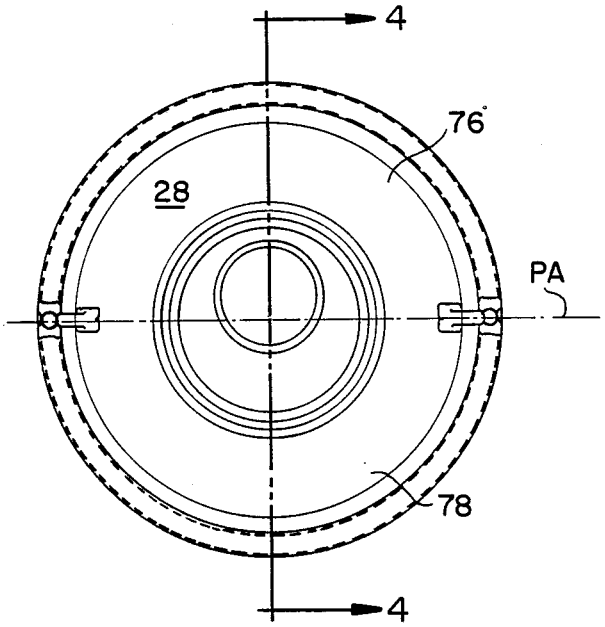
FIG. 3 is a left-side view of the first head.
Figure 4:
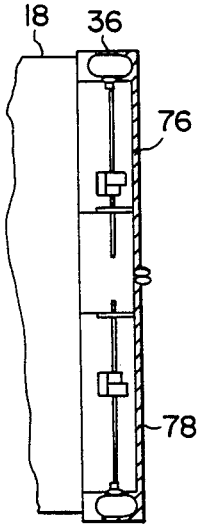
FIG. 4 is a sectional view taken on the line 4—4 of FIG. 3 showing the sectors in a locked disposition.
Figure 5:
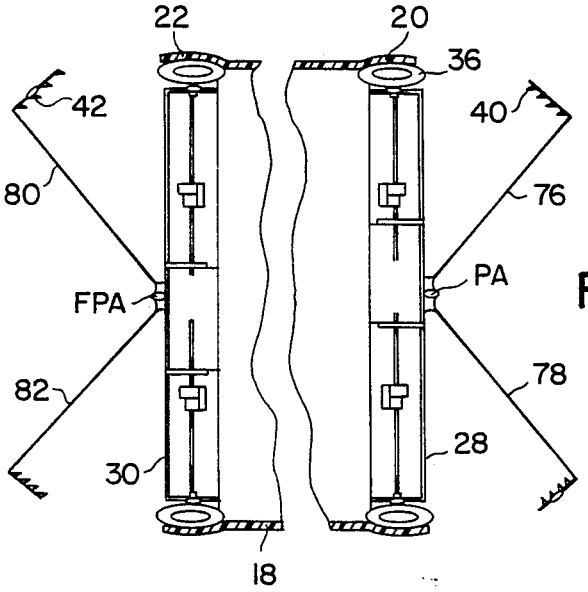
FIG. 5 is a fragmentary view similar to that shown in FIG. 4 with the sectors in an unlocked disposition.

FIG. 3 is a left-side view of the head 28 shown in FIG. 1 in which the first head also includes a first and a second sector 76 and 78 respectively. The sectors 76 and 78 are pivotally secured relative to each other about a pivotal axis PA which extends diametrically across the first head 28 such that outward pivoting of the sectors 76 and 78 about their pivotal axis PA, is permitted. FIG. 4 shows the sectors 76 and 78 in a locked disposition. FIG. 5 shows the sectors 76 and 78 in an outwardly pivoted disposition permitting release of the first lateral edge 20 of the blanket 18 from the first plurality of barbs 40.

As shown in FIG. 5, the second head 30 also includes a third and fourth sector 80 and 82 respectively. The third and fourth sectors 80 and 82 are pivotally secured relative to each other about a further pivotal axis FPA which extends diametrically across the second head 30 such that outward pivoting of the third and fourth sectors 80 and 82 about the further pivotal axis FPA, as shown in FIG. 5, permits release of the second lateral edge 22 of the blanket 18 from the second plurality of barbs 42.

As shown in FIG. 2, the annular seals 36 and 38 are inflatable by means of valves 84, 86. The first seal 36 is disposed within the first channel 32 such that the first seal 36 contacts the first circumferential rim 64, the first extension rim 66 and the inner surface 24 of the blanket 18. The second seal 38 is disposed within the second channel 34 such that the second seal 38 contacts the second circumferential rim 70 the second extension rim 72 and the inner surface 24 of the blanket 18.

The first plurality of barbs 40 extend from the first channel 32 towards the outer surface 26 of the blanket 18. The second plurality of barbs 42 extend from the second channel 34 towards the outer surface 26 of the blanket 18.

More specifically, as shown in FIG. 2, the first plurality of barbs 40 extend from the first cylindrical rim 68 towards the first extension rim 66. Furthermore, the second plurality of barbs 42 extend from the second cylindrical rim 74 towards the second extension rim 72 such that the first and the second plurality of barbs 40 and 42 respectively lock the respective edges 20 and 22 of the blanket 18 within the first and the second channels 32 and 34 respectively.

The present invention provides a simple means for locking the respective lateral edges of a press blanket to the respective rotating heads of an extended nip press so that lateral movement or wandering of the blanket relative to the heads is inhibited while maintaining a seal against the escape of oil mist between the moving blanket and heads.

What is claimed is:

1. An enclosed extended nip press apparatus for pressing water from a formed web, said apparatus comprising:

a frame;

a backing roll rotatably secured to said frame;

a press member cooperating with aid backing roll for defining therebetween an extended nip for the passage therethrough of the formed web;

a press blanket extending in a closed loop through said nip, said blanket having a first and a second lateral edge and an inner and an outer surface;

a first and second head rotatably secured relative to said press member, said first and second heads being disposed adjacent to and cooperating with said first and second edges respectively of said blanket;

said first and second heads defining first and second annular channels respectively for the reception therein of said first and second lateral edges respectively of said blanket;

a first and second inflatable annular seal disposed within respectively said first and second channels, said seals contacting said respective edges of said blanket; and a first and second plurality of barbs extending from said first and second channels respectively such that said first plurality of barbs extend towards and engage and penetrate said first lateral edge of said blanket and are disposed on the opposite surface of said blanket relative to said first seal, said second plurality of barbs extending towards and engaging and penetrating said second lateral edge of said blanket, said second plurality of barbs being disposed on the opposite surface of said blanket relative to said second seal so that during use of the apparatus, lateral movement of said edges of said blanket relative to said heads is inhibited.

2. An extended nip press apparatus as set forth in claim 1 wherein said press member includes:

a housing defining a cylinder, said cylinder being controllably connected to a source of hydraulic pressure;

an elongate pressing shoe slidably cooperating with said cylinder, such that when said cylinder is connected to said source of hydraulic pressure, said shoe is urged towards said backing roll for pressing water from the web.

3. An extended nip press apparatus as set forth in claim 1 wherein said blanket is vented.

4. An extended nip press apparatus as set forth in claim 3 wherein said blanket defines a plurality of machine direction grooves for assisting drainage of water pressed from the formed web during passage of the web through said extended nip.

5. An extended nip press apparatus as set forth in claim 4 wherein said blanket is fabricated from a resin binder with randomly oriented fibers dispersed therein.

6. An extended nip press apparatus as set forth in claim 2 wherein said inner surface of said blanket cooperates with and moves relative to said elongate pressing shoe.

7. An extended nip press apparatus as set forth in claim 1 wherein said first and second heads are of disc-shaped configuration, said heads rotating about a common axis disposed parallel and spaced relative to the rotational axis of said backing roll, said first head having a diameter substantially the same as the diameter of said second head.

8. An extended nip press apparatus as set forth in claim 7 wherein said first head further includes:

a first circumferential rim disposed coaxially relative to said common axis;

a first extension rim extending radially outward from said first circumferential rim;

a first cylindrical rim secured to said first extension rim and disposed coaxially and spaced relative to said first circumferential rim such that said first circumferential rim, said first extension rim and said first cylindrical rim define therebetween said first channel for the reception therein of said first lateral edge of said blanket;

said second head further including:

a second circumferential rim disposed coaxially relative to said common axis;

a second extension rim extending radially outward from said second circumferential rim;

a second cylindrical rim secured to said second extension rim and disposed coaxially and spaced relative to said second circumferential rim such that said second circumferential rim, said second extension rim and said second cylindrical rim define therebetween said second channel for the reception therein of said second lateral edge of said blanket.

9. An extended nip press apparatus as set forth in claim 8 wherein:

said first seal is disposed within said first channel such that said first seal contacts said first circumferential rim, said first extension rim and said inner surface of said blanket;

said second seal being disposed within said second channel such that said second seal contacts said second circumferential rim, said second extension rim and said inner surface of said blanket.

10. An extended nip press apparatus as set forth in claim 8 wherein:

said first plurality of barbs extend from said first cylindrical rim towards said first extension rim;

said second plurality of barbs extend from said second cylindrical rim towards said second extension rim such that said first and second plurality of barbs lock said respective edges of said blanket within said first and second channels respectively.

11. An extended nip press apparatus as set forth in claim 1 wherein:

said first plurality of barbs extend from said first channel towards said outer surface of said blanket;

said second plurality of barbs extend from said second channel towards said outer surface of said blanket.

12. An enclosed extended nip press apparatus for pressing water from a framed web, said apparatus comprising:

a frame;

a backing roll rotatably secured to said frame;

a press member cooperating with said backing roll for defining therebetween an extended nip for the passage therethrough of the formed web;

a press blanket extending in a closed loop through said nip, said blanket having a first and a second lateral edge and an inner and an outer surface;

a first and second head rotatably secured relative to said press member, said first and second heads being disposed adjacent to and cooperating with said first and second edges respectively of said blanket;

said first and second heads defining first and second annular channels respectively for the reception therein of said first and second lateral edges respectively of said blanket;

a first and second annular seal disposed within respectively said first and second channels, said seals contacting said respective edges of said blanket;

a first and second plurality of barbs extending from said first and second channels respectively such that said first plurality of barbs extend towards and engage said first lateral edge of said blanket and are disposed on the opposite surface of said blanket relative to said first seal, said second plurality of barbs extending towards and engaging said second lateral edge of said blanket, said second plurality of barbs being disposed on the opposite surface of said blanket relative to said second seal so that during used of the apparatus, lateral movement of said edges of said blanket relative to said heads is inhibited;

said first head further including:

a first and second sector, said sectors being pivotally secured relative to each other about a pivotal axis extending diametrically across said first head such that outward pivoting of said sectors about said pivotal axis permits release of said first lateral edge of said blanket from said first plurality of barbs; and said second head further including:

a third and fourth sector, said third and fourth sectors being pivotally secured relative to each other about a further pivotal axis extending diametrically across said second head such that outward pivoting of said third and fourth sectors about said further pivotal axis permits release of said second lateral edge of said blanket from said second plurality of barbs.

* * * * *